US012479480B2

(12) United States Patent
Zhang et al.

(10) Patent No.: US 12,479,480 B2
(45) Date of Patent: Nov. 25, 2025

(54) TILTING SYSTEM AND TILTING CONTROL METHOD FOR RAILWAY VEHICLE AND RAILWAY VEHICLE

(71) Applicant: CRRC QINGDAO SIFANG CO., LTD., Qingdao (CN)

(72) Inventors: Zhenxian Zhang, Qingdao (CN); Xu Wang, Qingdao (CN); Xin Yang, Qingdao (CN); Guiyu Li, Qingdao (CN); Hongyong Cao, Qingdao (CN)

(73) Assignee: CRRC QINGDAO SIFANG CO., LTD., Shandong (CN)

( * ) Notice: Subject to any disclaimer, the term of this patent is extended or adjusted under 35 U.S.C. 154(b) by 861 days.

(21) Appl. No.: 17/778,184

(22) PCT Filed: Feb. 23, 2021

(86) PCT No.: PCT/CN2021/077341
§ 371 (c)(1),
(2) Date: May 19, 2022

(87) PCT Pub. No.: WO2022/057202
PCT Pub. Date: Mar. 24, 2022

(65) Prior Publication Data

US 2022/0410946 A1 Dec. 29, 2022

(30) Foreign Application Priority Data

Sep. 18, 2020 (CN) ..... 202010990343.2

(51) Int. Cl.
*B61F 5/24* (2006.01)
*B61L 27/04* (2006.01)

(52) U.S. Cl.
CPC ..... *B61F 5/245* (2013.01); *B61L 27/04* (2013.01)

(58) Field of Classification Search
CPC . B61F 5/10; B61F 5/245; B61L 27/04; G06T 11/001
See application file for complete search history.

(56) References Cited

U.S. PATENT DOCUMENTS

2015/0353104 A1* 12/2015 Maeyama ..... B61F 9/00 701/19
2022/0410946 A1* 12/2022 Zhang ..... B61L 27/04

FOREIGN PATENT DOCUMENTS

CN 2446002 Y 9/2001
CN 1704297 A 12/2005
(Continued)

OTHER PUBLICATIONS

China National Intellectual Property Administration, International Search Report issued in corresponding Application No. PCT/CN2021/077341 mailed May 10, 2021.
(Continued)

*Primary Examiner* — Jason C Smith
(74) *Attorney, Agent, or Firm* — Stites & Harbison, PLLC; Jeffrey A. Haeberlin

(57) ABSTRACT

A rail vehicle tilting system, comprising a controller (101), a high-pressure air cylinder (102), a left side air spring (105), a right side air spring (107), a left side additional air chamber (106), a right side additional air chamber (108), a first three-position electromagnetic proportional flow valve (109), a second three-position electromagnetic proportional flow valve (110), a sensor, a differential pressure valve (104) and a two-position switch valve (111). The left side air spring (105) is in communication with the left side additional air chamber (106); the right side air spring (107) is in communication with the right side additional air chamber (108); the sensor is used for collecting data of a rail vehicle during running, and transmitting the collected data to the controller (101); the controller (101) controls, according to
(Continued)

data collected by the sensor, the first three-position electromagnetic proportional flow valve (109) and the second three-position electromagnetic proportional flow valve (110); the differential pressure valve (104) is used for enabling the left side additional air chamber (106) to be in communication with the right side additional air chamber (108); and the two-position switch valve (111) is respectively in communication with the left side additional air chamber (106) and the right side additional air chamber (108) by means of pipelines. Also disclosed are a rail vehicle tilting control method and a rail vehicle.

11 Claims, 2 Drawing Sheets

(56) References Cited

FOREIGN PATENT DOCUMENTS

| | | | | | |
|---|---|---|---|---|---|
| CN | 102378711 | A | | 3/2012 | |
| CN | 103153749 | A | | 6/2013 | |
| CN | 204871044 | U | | 12/2015 | |
| CN | 204955994 | U | * | 1/2016 | |
| CN | 108545093 | A | | 9/2018 | |
| CN | 209079902 | U | | 7/2019 | |
| CN | 110901676 | A | * | 3/2020 | ..... B61F 5/10 |
| CN | 210760748 | U | | 6/2020 | |
| CN | 112046533 | A | * | 12/2020 | ..... B61F 5/245 |
| CN | 213168083 | U | * | 5/2021 | |
| CN | 112572502 | B | * | 3/2022 | ..... B61F 5/52 |
| CN | 216833109 | U | * | 6/2022 | |
| CN | 115723504 | A | * | 3/2023 | |
| EP | 2765051 | A1 | * | 8/2014 | ..... B61F 5/12 |
| GB | 1379059 | A | | 1/1975 | |
| IN | 110641502 | A | | 1/2020 | |
| JP | H04278878 | A | * | 10/1992 | |
| JP | 2003-83340 | A | | 3/2003 | |
| JP | 2008100614 | A | * | 5/2008 | |
| JP | 2010-228694 | A | | 10/2010 | |
| JP | 2011-16441 | A | | 1/2011 | |
| JP | 2012-232718 | A | | 11/2012 | |
| JP | 5513175 | B2 | * | 6/2014 | |
| JP | 2014-141244 | A | | 8/2014 | |
| KR | 102810699 | B1 | * | 5/2025 | ..... F16F 15/0232 |
| WO | WO-2015071483 | A1 | * | 5/2015 | ..... B25J 9/009 |
| WO | 2022/057202 | A1 | | 3/2022 | |

OTHER PUBLICATIONS

China National Intellectual Property Administration, First Search Report issued in corresponding Application No. 2020109903432 mailed Sep. 18, 2020 (translation not available).

European Patent Office, Extended European Search Report issued in corresponding Application No. 21 868 042.9 dated Jun. 13, 2023.

* cited by examiner

TILTING SYSTEM AND TILTING CONTROL METHOD FOR RAILWAY VEHICLE AND RAILWAY VEHICLE

CROSS-REFERENCE TO RELATED APPLICATION

The present application claims priority to Chinese application No. 202010990343.2 filed on Sep. 18, 2020, entitled "Tilting System and Tilting Control Method for Railway Vehicle and Railway Vehicle", which is hereby incorporated by reference in its entirety.

FIELD OF TECHNOLOGY

The present application relates to the technical field of railway transportation, and in particular, to a tilting system and a tilting control method for railway vehicle and a railway vehicle.

BACKGROUND

A centrifugal force generated when a railway vehicle is running on a curved road will make passengers feel uncomfortable and even cause an overturning accident in severe cases.

Therefore, in the related art, an outer rail is generally raised to a certain extent, so as to balance the centrifugal force by a centripetal component force (which also called as centripetal force) generated by the body weight of the vehicle. This practice is also known as a superelevation of outer rail.

However, the superelevation of outer rail in some difficult road sections is usually insufficient due to being constrained by natural conditions during laying railway, which limits the speed of curve negotiating of railway vehicle and reduces the transportation efficiency. In addition, the speed-up operation of traditional lines also faces the problem of insufficient superelevation. In this case, the centrifugal force generated when the curve negotiating is performed often cannot be completely balanced and the centrifugal acceleration generated by the unbalanced centrifugal force will adversely affect the ride comfort of passengers.

The body of a titling train can swing at a certain angle relative to the rail plane, which reduces the unbalanced centrifugal acceleration to a certain extent and improves the ride comfort. Traditional titling trains generally require a complex tilting system on a secondary suspension structure, resulting in low reliability and high cost.

SUMMARY

In view of the problems in the related art, embodiments of the present application provide a tilting system and a tilting control method for railway vehicle, and a railway vehicle.

According to an embodiment of a first aspect of the present application, a tilting system for a railway vehicle is provided, including a controller, a high-pressure air cylinder, a left air spring, a right air spring, a left auxiliary air chamber, a right auxiliary air chamber, a first three-position electromagnetic proportional flow valve, a second three-position electromagnetic proportional flow valve, sensors, a differential pressure valve and a two-position switching valve, where the left air spring communicates with the left auxiliary air chamber and the right air spring communicates with the right auxiliary air chamber;

the sensors are configured to collect data of the railway vehicle while driving and transmit the collected data to the controller; the controller is configured to control the first three-position electromagnetic proportional flow valve and the second three-position electromagnetic proportional flow valve based on the data collected by the sensors such that high-pressure air in the high-pressure air cylinder is charged into the left air spring through the first three-position electromagnetic proportional flow valve and the high-pressure air in the high-pressure air cylinder is charged into the right air spring through the second three-position electromagnetic proportional flow valve, or air inside the left air spring is discharged into atmosphere through the first three-position electromagnetic proportional flow valve and air inside the right air spring is discharged into atmosphere through the second three-position electromagnetic proportional flow valve; and the differential pressure valve is configured to communicate with the left auxiliary air chamber and the right auxiliary air chamber; and the two-position switching valve communicates with the left auxiliary air chamber and the right auxiliary air chamber through pipelines respectively.

According to an embodiment, the sensors include an acceleration sensor and air spring height detection sensors, where the acceleration sensor is mounted on a side beam of a frame of the railway vehicle; and the air spring height detection sensors are mounted at adjacent positions of the left air spring and the right air spring.

According to an embodiment, the tilting system further includes a third three-position solenoid valve and a fourth three-position solenoid valve, where the third three-position solenoid valve communicates with the high-pressure air cylinder, the left air spring and the atmosphere, respectively; the fourth three-position solenoid valve communicates with the high-pressure air cylinder, the right air spring and the atmosphere, respectively; and the third three-position solenoid valve and the fourth three-position solenoid valve are controlled by the controller to open and close.

According to an embodiment, the third three-position solenoid valve is a three-position electromagnetic switching valve or a three-position electromagnetic proportional flow valve; and/or the fourth three-position solenoid valve is a three-position electromagnetic switching valve or a three-position electromagnetic proportional flow valve.

According to an embodiment of a second aspect of the present application, provided is a tilting control method of the tilting system of railway vehicle according to the embodiments of the first aspect of the present application, including:

step S11, receiving, by the controller, a real-time unbalanced centrifugal acceleration of a frame collected by an acceleration sensor, and comparing the real-time unbalanced centrifugal acceleration of the frame with a preset unbalanced centrifugal acceleration threshold; and step S12, generating, when the real-time unbalanced centrifugal acceleration of the frame is greater than the preset unbalanced centrifugal acceleration threshold, control instructions for the first three-position electromagnetic proportional flow valve and the second three-position electromagnetic proportional flow valve based on the real-time unbalanced centrifugal acceleration of the frame, a real-time height value of the left air spring and a real-time height value of the right air spring to perform an operation of charging air or discharging air on the left air spring and the right air spring such that a tilting operation is completed.

According to an embodiment, the generating control instructions for the first three-position electromagnetic proportional flow valve and the second three-position electromagnetic proportional flow valve based on the real-time unbalanced centrifugal acceleration of the frame, a real-time height value of the left air spring and a real-time height value of the right air spring includes:

calculating a tilting angle of a body of the railway vehicle based on the real-time unbalanced centrifugal acceleration of the frame;

calculating a target value of a height difference between the left air spring and the right air spring based on the tilting angle of the body of the railway vehicle;

calculating a height change target value of the left air spring, a height change target value of the right air spring, and a height change speed value of the left air spring and a height change speed value of the right air spring based on the target value of a height difference between the left air spring and the right air spring; and generating control instructions for the first three-position electromagnetic proportional flow valve and the second three-position electromagnetic proportional flow valve based on the received real-time height value of the left air spring and the real-time height value of the right air spring in combination with the height change target value of the left air spring, the height change target value of the right air spring, and the height change speed value of the left air spring and the height change speed value of the right air spring.

According to an embodiment, the generating control instructions for the first three-position electromagnetic proportional flow valve and the second three-position electromagnetic proportional flow valve based on the real-time unbalanced centrifugal acceleration of the frame, a real-time height value of the left air spring and a real-time height value of the right air spring includes:

calculating a change rate of the real-time unbalanced centrifugal acceleration of the frame based on the real-time unbalanced centrifugal acceleration of the frame; and obtaining a feedforward control amount of the left air spring and a feedforward control amount of the right air spring based on the change rate of the real-time unbalanced centrifugal acceleration of the frame;

calculating a height target value of the left air spring and a height target value of the right air spring based on the real-time unbalanced centrifugal acceleration of the frame;

determining a feedback control amount of the left air spring based on the real-time height value of the left air spring and the height target value of the left air spring; and determining a feedback control amount of the right air spring based on the real-time height value of the right air spring and the height target value of the right air spring; and generating the control instruction for the first three-position electromagnetic proportional flow valve based on the feedback control amount of the left air spring and the feedforward control amount of the left air spring; and generating the control instruction for the second three-position electromagnetic proportional flow valve based on the feedback control amount of the right air spring and the feedforward control amount of the right air spring.

According to an embodiment, the method further includes:

when the railway vehicle exits a curve road section, balancing the left air spring and the right air spring, where when the railway vehicle exits an easement curve road section, the real-time unbalanced centrifugal acceleration of the frame gradually decreases, and an outer air spring begins to discharge air and a height of the outer air spring is lowered; when a height deviation value of the left air spring is equal to a height deviation value of the right air spring, the two-position control switching valve is opened to allow air inside an outer air spring to flow into an inner air spring such that the left air spring and right air spring return to a balanced state.

the outer air spring is an air spring with a relatively higher height of the left air spring and the right air spring, and the inner air spring is an air spring with a relatively lower height of the left air spring and the right air spring, and the height deviation value of the air spring is a difference between the real-time height value of the air spring and the target height value of the air spring.

According to an embodiment, the method further includes:

step S21, when the real-time unbalanced centrifugal acceleration of the frame is less than or equal to the preset unbalanced centrifugal acceleration threshold receiving, by the controller, the real-time height value of the left air spring and the real-time height value of the right air spring, and calculating a first height deviation value based on the real-time height value of the left air spring and a second height deviation value based on the real-time height value of the right air spring; and step S22, comparing the first height deviation value with a preset first interval, and when the first height deviation value exceeds the first interval, adjusting the height of the left air spring by controlling the first three-position electromagnetic proportional flow valve and comparing the second height deviation value with a preset second interval, and when the second height deviation value exceeds the second interval, adjusting the height of the right air spring by controlling the second three-position electromagnetic proportional flow valve.

According to an embodiment of a third aspect of the present application, provided is a railway vehicle, including:

the tilting system for railway vehicle described in the embodiments of the first aspect of the present application.

In the tilting system for railway vehicle, the tilting control method and the railway vehicle according to the embodiments of the present application, the height difference of the left and right air springs can be adjusted based on the driving state of the railway vehicle, thereby the tilting angle is adjusted, which is beneficial to balance centrifugal force generated by the railway vehicle when running on curved road sections.

BRIEF DESCRIPTION OF THE DRAWINGS

In order to more clearly illustrate technical solutions disclosed in the embodiments of the present application or the prior art, the drawings used in the descriptions of the embodiments or the prior art will be briefly described below. The drawings in the following description are only certain embodiments of the present application, and other drawings can be obtained according to the drawings without any creative work for those skilled in the art.

DETAILED DESCRIPTION

In order to make the objectives, technical solutions and advantages of the embodiments of the present application clearer, the technical solutions in the embodiments of the present application are clearly and completely described in the following in conjunction with the accompanying drawings in the embodiments of the present application. These embodiments are a part of the embodiments of the present application, and not all of the embodiments. All other embodiments obtained by a person of ordinary skill in the art based on the embodiments of the present application without any creative work belong to the protection scope of the present application.

Figure 1:
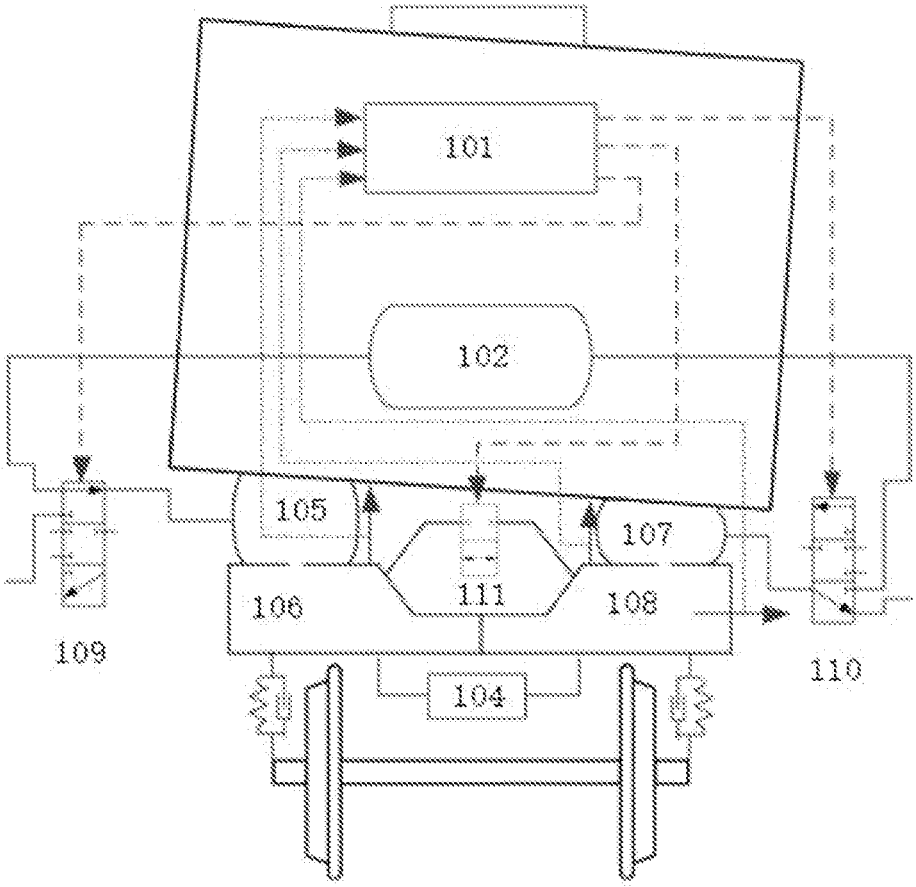
FIG. 1 is a schematic structural diagram of a tilting system for railway vehicle according to an embodiment of the present application.

FIG. 1 is a schematic structural diagram of a tilting system for railway vehicle according to an embodiment of the present application. As shown in FIG. 1, the tilting system for railway vehicle according to an embodiment of the present application includes: a controller 101, a high-pressure air cylinder 102, an air compressor (which is not shown in FIG. 1), air springs, three-position electromagnetic proportional flow valves, sensors, a differential pressure valve 104, auxiliary air chambers, and a two-position switching valve 111. The air springs include a left air spring 105 and a right air spring 107; the auxiliary air chambers include a left auxiliary air chamber 106 and a right auxiliary air chamber 108; and the three-position electromagnetic proportional flow valves include a first three-position electromagnetic proportional flow valve 109 and a second three-position electromagnetic proportional flow valve 110. The air compressor is configured to provide high-pressure air to the high-pressure air cylinder 102 and the high-pressure air cylinder 102 is configured to charge the high-pressure air into the left air spring 105 through the first three-position electromagnetic proportional flow valve 109 and charge the high-pressure air into the right air spring 107 through the second three-position electromagnetic proportional flow valve 110. The left air spring 105 discharges air therein to atmosphere through the first three-position electromagnetic proportional flow valve 109 and the right air spring 107 discharges air therein to atmosphere through the second three-position electromagnetic proportional flow valve 110; the left air spring 105 communicates with the left auxiliary air chamber 106 and the right air spring 107 communicates with the right auxiliary air chamber 108. The differential pressure valve 104 is configured to communicate with the left auxiliary air chamber 106 and the right auxiliary air chamber 108 to perform pressure balance of air inside the left auxiliary air chamber 106 and the right auxiliary air chamber 108 as desired; and the two-position switching valve 111 communicates with the left auxiliary air chamber 106 and the right auxiliary air chamber 108 through pipelines, respectively. The sensors are configured to collect data of the railway vehicle while driving and transmit the collected data to the controller 101; the controller 101 is configured to control the first three-position electromagnetic proportional flow valve 109 and the second three-position electromagnetic proportional flow valve 110 based on the data collected by the sensors.

Components in the tilting system for railway vehicle are further described below.

The left air spring 105 is mounted under a left side of the body of the railway vehicle. The left air spring 105 communicates with the left auxiliary air chamber 106 and air can flow between the left auxiliary air chamber 106 and the left air spring 105.

The right air spring 107 is mounted under a right side of the body of the railway vehicle. The right air spring 107 communicates with the right auxiliary air chamber 108 and air can flow between the right auxiliary air chamber 108 and the right air spring 107.

There are a plurality of the left air springs 105 and a plurality of the right air springs 107. For example, four air springs including two left air springs 105 and two right air springs 106, are included in a carriage of a railway vehicle.

The first three-position electromagnetic proportional flow valve 109 and the second three-position electromagnetic proportional flow valve 110 are electrically connected to the controller 101, respectively, and the first three-position electromagnetic proportional flow valve 109 and/or the second three-position electromagnetic proportional flow valve 110 adjust an air flow direction (such as charging air into or discharging air from the air spring) and a air flow rate under the control of the controller 101.

Specifically, the first three-position electromagnetic proportional flow valve 109 has three air inlet-outlets among which a first air inlet-outlet communicates with the high-pressure air cylinder 102, a second air inlet-outlet communicates with the atmosphere through a discharge pipe and a third air inlet-outlet communicates with the left air spring 105 through a pipeline. When it's need to charge air into the left air spring 105, the first air inlet-outlet communicates with the third air inlet-outlet under the control of the controller 101, and since the air pressure in the high-pressure air cylinder 102 is higher, the air can flow from the high-pressure air cylinder 102 to the left air spring 105 to charge air into the left air spring 105. When it's need to close the left air spring 105, the three air inlet-outlets do not communicate under the control of the controller 101 to maintain the stability of the air inside the left air spring 105. When it's need to discharge air from the left air spring 105, the second air inlet-outlet communicates with the third air inlet-outlet under the control of the controller 101, and since the air pressure in the left air spring 105 is higher, the air can flow from the left air spring 105 to the atmosphere to discharge air from the left air spring 105.

The second three-position electromagnetic proportional flow valve 110 has three air inlet-outlets among which a first air inlet-outlet communicates with the high-pressure air cylinder 102, a second air inlet-outlet communicates with the atmosphere through a discharge pipe and a third air inlet-outlet communicates with the right air spring 107 through a pipeline. The charging, discharging and closing of the right air spring 107 can be completed using the second three-position electromagnetic proportional flow valve 110. The specific implementation process is similar to the implementation process of the first three-position electromagnetic proportional flow valve 109 for the left air spring 105, and will not be repeated here.

The number of the first three-position electromagnetic proportional flow valves 109 corresponds to the number of the left air springs 105 and the number of the second three-position electromagnetic proportional flow valves 110 corresponds to the number of the right air springs 107.

The sensors include an acceleration sensor and air spring height detection sensors.

Figure 2:
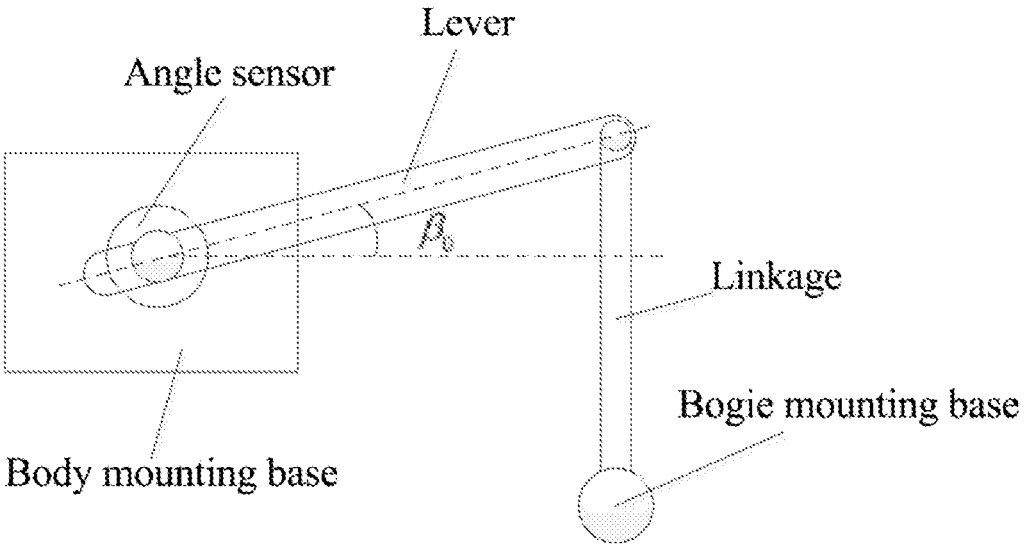
FIG. 2 is a schematic diagram showing installation of an acceleration sensor.

FIG. 2 is a schematic diagram showing installation of the acceleration sensor. As shown in FIG. 2, the acceleration sensor is mounted on a side beam of the frame of the railway vehicle and the acceleration sensor is configured to detect the unbalanced centrifugal acceleration of the frame.

The air spring height detection sensors are configured to detect the heights of air springs. Since the height of each air spring may be different, a height detection sensor needs to be provided for each air spring. As a preferred implementation, a non-contact angle sensor is used as the air spring height detection sensor to reduce wear and improve reliability.

The differential pressure valve 104 communicates with the left auxiliary air chamber 106 and the right auxiliary air chamber 108 through pipelines, respectively. According to an embodiment of the present application, the differential pressure valve 104, as a safety component of the entire system, has an opening pressure set to a higher value (e.g., 250±20 kPa). Under normal circumstances, even when the railway vehicle is in the maximum tilting state, the differential pressure valve 104 is still in the closed state; while in a fault state, if an air spring at a side is completely out of air, the pressure difference between the left and right air springs reaches the opening threshold of the differential pressure valve 104, and the differential pressure valve 104 is automatically opened, which reduces the height difference of the left and right air springs and thus ensures the safe operation of the railway vehicle.

The differential pressure valve 104, as a safety component of the entire system, will only be opened under the most unfavorable fault conditions to urgently balance the air pressure difference between the left auxiliary air chamber 106 and the right auxiliary air chamber 108. The two-position switching valve 111, as a conventional component, is closed when the railway vehicle enters a section with an easement curve and/or a section with a circular curve (when the railway vehicle runs on the curved road section, the section is changed as follows: straight line—entering an easement curve—circle curve—exiting the easement curve—straight line) so that airbags on both sides maintain the height difference, and the two-position switching valve 111 is opened when the railway vehicle exits the section with the easement curve such that the airbags on both sides restore to the same height. When the railway vehicle runs on straight line, the two-position switching valve 111 is also closed.

In the tilting system for railway vehicle according to the embodiments of the present application, the height difference between the left air spring 105 and the right air spring 107 can be adjusted based on the driving state of the railway vehicle, thereby the tilting angle is adjusted, which is beneficial to balance centrifugal force generated by the railway vehicle when running on curved road sections.

Figure 3:
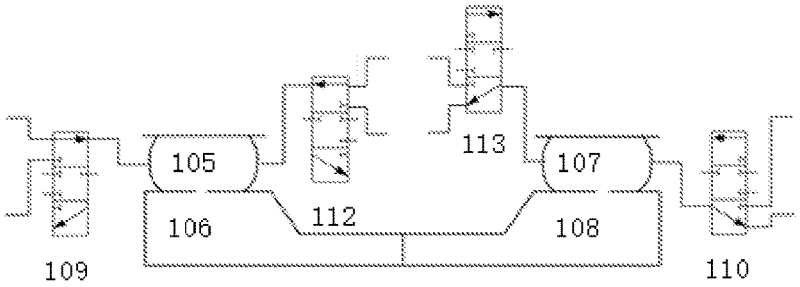
FIG. 3 is a schematic diagram of a tilting system for railway vehicle according to another embodiment of the present application.

Based on any one of the above embodiments, FIG. 3 is a schematic diagram of a tilting system for railway vehicle according to another embodiment of the present application. As shown in FIG. 3, the tilting system for railway vehicle according to another embodiment of the present application further includes: a third three-position solenoid valve 112 and a fourth three-position solenoid valve 113, wherein the third three-position solenoid valve 112 communicates with the high-pressure air cylinder 102, the left air spring 105 and the atmosphere, respectively; the fourth three-position solenoid valve 113 communicates with the high-pressure air cylinder 102, the right air spring 107 and the atmosphere, respectively; and the third three-position solenoid valve 112 and the fourth three-position solenoid valve 113 are controlled by the controller 101 to open and close.

In the embodiment of the present application, the third three-position solenoid valve 112 and the fourth three-position solenoid valve 113 are additionally provided for the tilting system for railway vehicle. The third three-position solenoid valve 112 is connected in parallel to the first three-position electromagnetic proportional flow valve 109, and can speed up the charging air speed or discharging air speed of the left air spring 105 by cooperating with the first three-position electromagnetic proportional flow valve 109. The fourth three-position solenoid valve 113 is connected in parallel to the second three-position electromagnetic proportional flow valve 110, and can speed up the charging air speed or discharging air speed of the right air spring 107 by cooperating with the second three-position electromagnetic proportional flow valve 110.

Each of the third three-position solenoid valve 112 and the fourth three-position solenoid valve 113 can be a three-position electromagnetic switching valve, or a three-position electromagnetic proportional flow valve. It can be selected according to actual needs.

By additionally arranging solenoid valves, the tilting system for railway vehicle according to the embodiment of the present application can speed up the charging air speed or discharging air speed of the air spring, which is beneficial to quickly adjust the state of the railway vehicle and reduce the impact of centrifugal force on passenger comfort.

Figure 4:
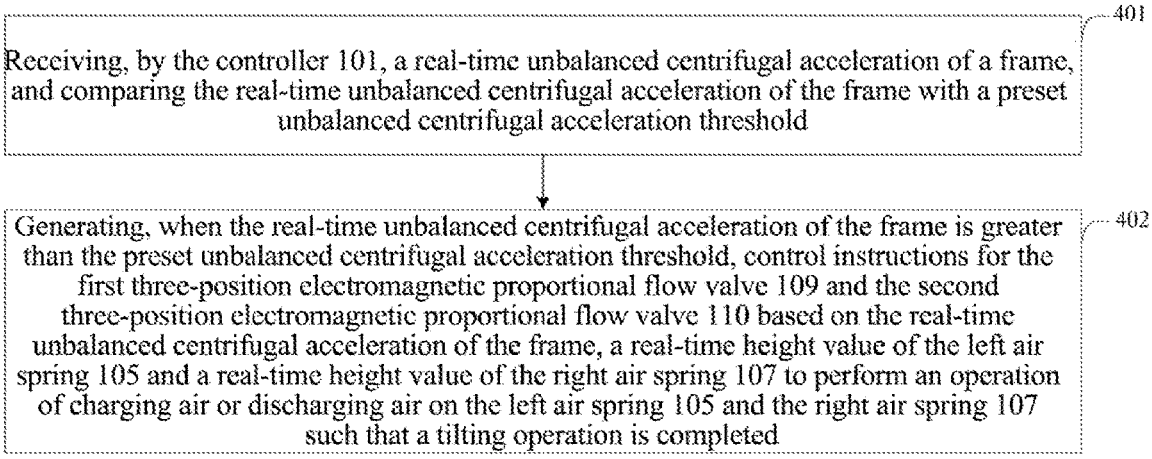
FIG. 4 is a flow chart of a tilting control method according to an embodiment of the present application.

Based on any one of the foregoing embodiments, FIG. 4 is a flow chart of a tilting control method according to an embodiment of the present application. As shown in FIG. 4, the tilting control method according to an embodiment of the present application includes the following steps.

Step 401, receiving, by the controller 101, a real-time unbalanced centrifugal acceleration of a frame, and comparing the real-time unbalanced centrifugal acceleration of the frame with a preset unbalanced centrifugal acceleration threshold.

In this step, the real-time unbalanced centrifugal acceleration of the frame is collected by an acceleration sensor disposed on the side beam of the frame of the railway vehicle and transmitted to the controller 101 by the acceleration sensor.

The unbalanced centrifugal acceleration threshold represents a maximum unbalanced centrifugal acceleration allowed for the railway vehicle. When the real-time unbalanced centrifugal acceleration of the frame is less than the unbalanced centrifugal acceleration threshold, it is considered that the railway vehicle is running on a straight line road or a curve road with sufficient superelevation, and the system enters a height adjustment mode. When the real-time unbalanced centrifugal acceleration of the frame is greater than or equal to the unbalanced centrifugal acceleration threshold, it is considered that the centrifugal acceleration of the railway vehicle needs to be balanced, and the system enters an active tilting mode. In the embodiment of the present application, the implementation process of the active tilting mode will be further described.

Step 402, generating, when the real-time unbalanced centrifugal acceleration of the frame is greater than the preset unbalanced centrifugal acceleration threshold, control instructions for the first three-position electromagnetic proportional flow valve 109 and the second three-position electromagnetic proportional flow valve 110 based on the real-time unbalanced centrifugal acceleration of the frame, a real-time height value of the left air spring 105 and a real-time height value of the right air spring 107 to perform an operation of charging air or discharging air on the left air spring 105 and the right air spring 107 such that a tilting operation is completed.

When the real-time unbalanced centrifugal acceleration of the frame is greater than a preset unbalanced centrifugal acceleration threshold, the railway vehicle enters an active tilting mode.

In the active tilting mode, control instructions for the first three-position electromagnetic proportional flow valve 109 and the second three-position electromagnetic proportional flow valve 110 are generated based on the real-time unbalanced centrifugal acceleration of the frame, a real-time height value of the left air spring 105 and a real-time height value of the right air spring 107 to perform the operation of charging air or discharging air on the left air spring 105 and the right air spring 107 such that a tilting operation is completed. In other embodiments of the present application, the specific generation process of the control instructions will be further described.

In the tilting control method for railway vehicle according to the embodiments of the present application, the height difference between the left air spring 105 and the right air spring 107 can be adjusted based on the driving state of the railway vehicle, thereby the tilting angle is adjusted, which is beneficial to balance centrifugal force generated by the railway vehicle when running on curved road sections.

Based on any one of the above embodiments, according to an embodiment, the generating control instructions for the first three-position electromagnetic proportional flow valve 109 and the second three-position electromagnetic proportional flow valve 110 based on the real-time unbalanced centrifugal acceleration of the frame, a real-time height value of the left air spring 105 and a real-time height value of the right air spring 107 includes:

calculating a tilting angle of a body of the railway vehicle based on the real-time unbalanced centrifugal acceleration of the frame;

calculating a target value of a height difference between the left air spring and the right air spring based on the tilting angle of the body of the railway vehicle;

calculating a height change target value of the left air spring, a height change target value of the right air spring, a height change speed value of the left air spring and a height change speed value of the right air spring based on the target value of a height difference between the left air spring and the right air spring; and generating control instructions for the first three-position electromagnetic proportional flow valve 109 and the second three-position electromagnetic proportional flow valve 110 based on the received real-time height value of the left air spring 105 and the real-time height value of the right air spring 107 in combination with the height change target value of the left air spring 105, the height change target value of the right air spring 107, the height change speed value of the left air spring 105 and the height change speed value of the right air spring 107.

Specifically, in the embodiment of the present application, the tilting angle of the body of the railway vehicle is calculated based on the real-time unbalanced centrifugal acceleration of the frame using the following equation:

$$\theta_{ref} = \frac{a_{nc} - a_{nc0}}{g}.$$

Where $\theta_{ref}$ is the tilting angle of the body of the railway vehicle, an, is the real-time unbalanced centrifugal acceleration of the frame; $\alpha_{nc0}$ is an allowable maximum unbalanced centrifugal acceleration, which is a preset value; and g is the gravitational acceleration.

The target value of a height difference between the left air spring 105 and the right air spring 107 is calculated based on the tilting angle of the body of the railway vehicle using the following equation:

$$\beta z = 2b \cdot \theta_{ref}$$

Where $\Delta z$ represents the target value of the height difference between the left air spring 105 and the right air spring 107; and 2*b* is a lateral span between the left air spring 105 and the right air spring 107, which is an actual measurable value.

Assuming that the current height values of the left air spring 105 and the right air spring 107 are both at the same reference value, the target value of a height difference between the left air spring 105 and the right air spring 107 can be further decomposed into a height change target value of the left air spring 105 and a height change target value of the right air spring 107.

Taking the left air spring 105 raising and the right air spring 107 lowering as an example:

$$\Delta z = \Delta z_L + \Delta z_R$$

In this equation, $\Delta z_L$, represents the raised height target value of the left air spring 105, and $\Delta z_R$ represents the lowered height target value of the right air spring 107.

$\Delta z_R$ is calculated by the following equation:

$$\Delta z_R = \begin{cases} \frac{\Delta z}{2}, & \Delta z \le 2 \times \Delta z_{R,max} \\ \Delta z_{R,max}, & \Delta z > 2 \times \Delta z_{R,max} \end{cases}.$$

Where $\Delta z_{R,max}$ represents a maximum allowable lowering height of the right air spring 107, which is a preset value.

$\Delta z_L$ is calculated by the following equation:

$$\Delta z_L = \begin{cases} \Delta z - \Delta z_R, & \Delta z \le \Delta z_{R,max} + \Delta z_{L,max} \\ \Delta z_{L,max}, & \Delta z > \Delta z_{R,max} + \Delta z_{L,max} \end{cases}.$$

Where $\Delta z_{L,max}$ represents a maximum allowable raising height of the left air spring 105, which is a preset value.

After the height change target values of the left air spring 105 and the right air spring 107 are obtained, the height change target values can be differentiated to obtain the height change speed value.

After the height change target value of the left air spring 105, the height change target value of the right air spring 107, the height change speed value of the left air spring 105 and the height change speed value of the right air spring 107 are obtained, corresponding control instructions for the first three-position electromagnetic proportional flow valve 109 and the second three-position electromagnetic proportional flow valve 110 are generated based on these values in combination with real-time height value of the left air spring 105 and the real-time height value of the right air spring 107.

As for the tilting control method of the present embodiment, the tilting angle of the body of the railway vehicle is calculated based on the real-time unbalanced centrifugal acceleration of the frame of the railway vehicle, and then the height change target value and the height change speed value of the air springs are calculated, and finally control instructions for the three-position electromagnetic proportional flow valves are generated, which is beneficial to precisely control the tilting of the railway vehicle and balance the centrifugal force generated by the railway vehicle when it runs on curved road sections.

Based on any one of the above embodiments, according to an embodiment, the generating control instructions for the first three-position electromagnetic proportional flow valve 109 and the second three-position electromagnetic proportional flow valve 110 based on the real-time unbalanced centrifugal acceleration of the frame, a real-time height value of the left air spring 105 and a real-time height value of the right air spring 107 includes:

calculating a change rate of the real-time unbalanced centrifugal acceleration of the frame based on the real-time unbalanced centrifugal acceleration of the frame; and obtaining a feedforward control amount of the left air spring 105 and a feedforward control amount of the right air spring 107 based on the change rate of the real-time unbalanced centrifugal acceleration of the frame;

calculating a height target value of the left air spring 105 and a height target value of the right air spring 107 based on the real-time unbalanced centrifugal acceleration of the frame;

determining a feedback control amount of the left air spring 105 based on the real-time height value of the left air spring 105 and the height target value of the left air spring 105; and determining a feedback control amount of the right air spring 107 based on the real-time height value of the right air spring 107 and the height target value of the right air spring 107; and generating the control instruction for the first three-position electromagnetic proportional flow valve 109 based on the feedback control amount of the left air spring 105 and the feedforward control amount of the left air spring 105; and generating the control instruction for the second three-position electromagnetic proportional flow valve 110 based on the feedback control amount of the right air spring 107 and the feedforward control amount of the right air spring 107.

In the previous embodiments of the present application, it is theoretically described how to calculate the tilting angle of the body of the railway vehicle based on the real-time unbalanced centrifugal acceleration of the frame of the railway vehicle, and then calculate the height change target value and height change speed value of the air springs and finally, generate control instructions for the three-position electromagnetic proportional flow valves. However, in actual operations, the accuracy and real-time performance of control are greatly affected due to external interference and time delay in the data processing process. Therefore, in the embodiment of the present application, the process of generating the control instructions for the electromagnetic proportional flow valves can be performed by combining the feedforward control amounts and the feedback control amounts.

Figure 5:
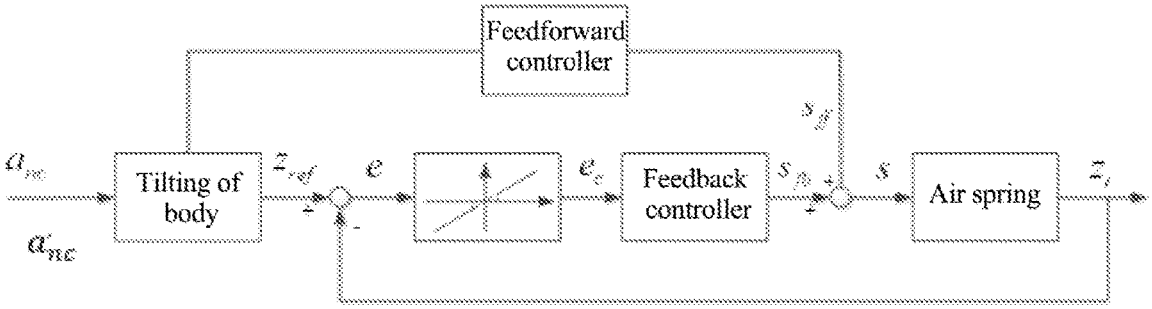
FIG. 5 is a schematic diagram showing a control mode of a combination of feedforward control and feedback control in a tilting control method for railway vehicle according to an embodiment of the present application.

FIG. 5 is a schematic diagram showing a control mode of a combination of feedforward control and feedback control in a tilting control method for railway vehicle according to an embodiment of the present application. As shown in FIG. 5, a rate of change $\alpha'_{nc}$ of the real-time unbalanced centrifugal acceleration of the frame (for example, the differential value of the real-time unbalanced centrifugal acceleration) is calculated based on the real-time unbalanced centrifugal acceleration $a_{nc}$ of the frame. A feedforward controller obtains a feedforward control amount $s_{ff}$ of the left (right) air spring by, for instance, multiplying the rate of change $\alpha'_{nc}$ of the real-time unbalanced centrifugal acceleration of the frame by an experimentally measured proportional coefficient based on the rate of change $a'_{nc}$ of the real-time unbalanced centrifugal acceleration of the frame, and compares the actual height values $z_f$ of the left (right) air spring with height target values $Z_{ref}$ of the left (right) air spring (which can be obtained by the height change target value and the height reference value of the air spring). When the difference e between the actual height values $z_f$ of the left (right) air spring and the height target values $Z_{ref}$ of the left (right) air spring is outside a preset interval range (threshold), a feedback controller generates the feedback control amount $s_{fb}$ based on a difference $e_c$ judged by the threshold (e.g., obtained by using the PID algorithm) and then obtains the final control amount s ($s=s_{fb}+s_{ff}$) based on the feedback control amount $s_{fb}$ and the feedforward control amount $s_{ff}$. The operation of charging air or discharging air on the left (right) air spring is controlled based on the control amount s until the difference between the actual height value of the left (right) air spring and the height target value of the left (right) air spring is within the preset interval range, thereby the tilting action of the railway vehicle is realized.

The feedforward control is a predictive control method, which can compensate a control signal at the next moment based on a change trend of the observed amount, so that the actual control signal is closer to the ideal value.

In the tilting control method for railway vehicle according to the embodiments of the present application, feedforward control and feedback control are combined, thereby generating control instructions for electromagnetic proportional flow valves. It is beneficial to improve the speed of responsiveness.

Based on any one of the above embodiments, in an embodiment, the method further includes:

when the railway vehicle exits a curve road section, balancing the left air spring 105 and the right air spring 107.

When the railway vehicle exits an easement curve road section, the real-time unbalanced centrifugal acceleration of the frame gradually decreases, and the outer air spring begins to discharge air and the height of the outer air spring is lowered. When the height deviation values of the air springs on both sides are equal, the two-position control switching valve is opened, so that the air inside the outer air spring flows into the inner air spring, and the left and right air springs return to a balanced state.

It can be easily understood by those skilled in the art that the outer air spring described in the embodiment of the present application is an air spring with a relatively higher height of the left air spring 105 and the right air spring 107, and the inner air spring is an air spring with a relatively lower height of the left air spring 105 and the right air spring 107. The height deviation value of the air spring is a difference between the real-time height value of the left and right air springs and the target height value of the left and right air springs. For example, the height deviation value of the left air spring is a difference between the real-time height value of the left air spring and the target height value of the left air spring; and the height deviation value of the right air spring is a difference between the real-time height value of the right air spring and the target height value of the right air spring.

In the tilting control method for railway vehicle according to the embodiments of the present application, the height difference between the left air spring 105 and the right air spring 107 can be adjusted based on the driving state of the railway vehicle, thereby the tilting angle is adjusted, which is beneficial to balance centrifugal force generated by the railway vehicle when running on curved road sections.

Based on any one of the above embodiments, in an embodiment, the method further includes:

when the real-time unbalanced centrifugal acceleration of the frame is less than or equal to the preset unbalanced centrifugal acceleration threshold, receiving, by the controller 101, the real-time height value of the left air spring 105 and the real-time height value of the right air spring 107, and calculating a first height deviation value based on the real-time height value of the left air spring 105 and a second height deviation value based on the real-time height value of the right air spring 107; and comparing the first height deviation value with a preset first interval, and when the first height deviation value is outside the first interval, adjusting the height of the left air spring 105 by controlling the first three-position electromagnetic proportional flow valve 109; and comparing the second height deviation value with a preset second interval, and when the second height deviation value is outside the second interval, adjusting the height of the right air spring 107 by controlling the second three-position electromagnetic proportional flow valve 110.

In the present embodiment, when the real-time unbalanced centrifugal acceleration of the frame is less than or equal to the preset unbalanced centrifugal acceleration threshold, the railway vehicle enters a height-adjusting mode.

In a specific implementation, the real-time height value of the left air spring 105 can be obtained through a height detection sensor provided for the left air spring 105 and the real-time height of the right air spring 107 can be obtained through a height detection sensor provided for the right air spring 107.

After obtaining the real-time height value of the left air spring 105 and the real-time height value of the right air spring 107 from the corresponding sensors, the controller 101 compares the real-time height value of the left air spring 105 with a preset first height target value to obtain a first height deviation value of the left air spring 105, and compares the real-time height value of the right air spring 107 with a preset second height target value to obtain a second height deviation value of the right air spring 107. The first height target value and the second height target value are set according to actual needs, and they may be the same or different.

Whether heights of the left and right air springs needs to be adjusted and how to adjust the heights of the left and right air springs are controlled separately. Taking the left air spring 105 as an example, it is first determined that whether the first height deviation value is within the preset first interval. When the first height deviation value is within the first interval, it means that the first height deviation value of the left air spring 105 is within the allowable range and thus the height of the left air spring 105 does not need to be adjusted. When the first height deviation value is outside the first interval, the height of the left air spring 105 needs to be adjusted. During adjustment, whether the height of the left air spring 105 should be rasised or lowered is determined based on whether the first height deviation value is positive or negative. When the height of the left air spring 105 needs to be raised, a control instruction is generated for the first three-position electromagnetic proportional flow valve 109, and the left air spring 105 is charged air through the first three-position electromagnetic proportional flow valve 109; and when the height of the left air spring 105 needs to be lowered, a control instruction is generated for the first three-position electromagnetic proportional flow valve 109, and the left air spring 105 is discharged air through the first three-position electromagnetic proportional flow valve 109. In the process of charging air or discharging air, the real-time height value of the left air spring 105 is continuously measured, and when the first height deviation value is within the preset first interval, the operation of charging air or discharging air on the left air spring 105 is stopped.

The operation on the right air spring 107 is similar to the operation on the left air spring 105 described above.

It should be noted that, the first interval range and the second interval range may be the same or different, which is specifically determined based on the actual situation.

According to the tilting control method for railway vehicle, when the real-time unbalanced centrifugal acceleration of the frame of the railway vehicle is less than or equal to the preset unbalanced centrifugal acceleration threshold, the height of the air springs are adjusted so as to adjust the state of the railway vehicle and reduce the effect of centrifugal force on passenger comfort.

Based on any one of the above embodiments, another embodiment of the present application provides a railway vehicle, including:

the tilting system for a railway vehicle.

In the railway vehicle according to the embodiments of the present application, the height difference between the left air spring and the right air spring can be adjusted based on the driving state of the railway vehicle, thereby the tilting angle is adjusted, which is beneficial to balance centrifugal force generated by the railway vehicle when running on curved road sections.

The device embodiments described above are merely illustrative, where the units described as separate components may or may not be physically separate, and the components displayed as units may or may not be physical units, that is, may be located at the same place or be distributed to multiple network units. Some or all of the modules may be selected according to actual needs to achieve the objectives of the solutions of the present embodiment. Those of ordinary skill in the art can understand and implement the embodiments described above without paying creative labors.

Through the description of the embodiments above, those skilled in the art can clearly understand that the various embodiments can be implemented by means of software and a necessary general hardware platform, and of course, by hardware. The technical solutions mentioned above may be embodied in the form of a software product, which is stored in a storage medium such as ROM/RAM, magnetic disc, compact disc, etc., including several instructions to cause a computer device (may be a personal computer, server, or network device, etc.) to perform various embodiments or a part of the methods described in various embodiments.

Finally, it should be noted that the above embodiments are only used to explain the technical solutions of the present application, and are not limited thereto; although the present application has been described in detail with reference to the foregoing embodiments, it should be understood by those skilled in the art that they can still modify the technical solutions documented in the foregoing embodiments and make equivalent substitutions to a part of the technical features; these modifications and substitutions do not make the essence of the corresponding technical solutions depart from the scope of the technical solutions of various embodiments of the present application.

What is claimed is:

1. A tilting system for railway vehicle, comprising a controller, a high-pressure air cylinder, a left air spring, a right air spring, a left auxiliary air chamber, a right auxiliary air chamber, a first three-position electromagnetic proportional flow valve, a second three-position electromagnetic proportional flow valve, sensors, a differential pressure valve and a two-position switching valve, wherein the left air spring communicates with the left auxiliary air chamber and the right air spring communicates with the right auxiliary air chamber;

the sensors comprise an acceleration sensor and a height detection sensor provided for a left air spring and a height detection sensor provided for a right air spring, the acceleration sensor is mounted on a side beam of a frame of the railway vehicle and configured to detect an unbalanced centrifugal acceleration of the frame and transmit the unbalanced centrifugal acceleration of the frame to the controller;

the height detection sensor provided for the left air spring and the height detection sensor provided for the right air spring are mounted at adjacent positions of the left air spring and the right air spring and configured to detect a real-time height value of the left air spring and a real-time height value of the right air spring and transmit the real-time height value of the left air spring and the real-time height value of the right air spring to the controller;

wherein the controller is configured to control the first three-position electromagnetic proportional flow valve and the second three-position electromagnetic proportional flow valve based on the real-time unbalanced centrifugal acceleration of the frame, the real-time height value of the left air spring and the real-time height value of the right air spring such that high-pressure air in the high-pressure air cylinder is charged into the left air spring through the first three-position electromagnetic proportional flow valve and charged into the right air spring through the second three-position electromagnetic proportional flow valve, or air inside the left air spring is discharged into atmosphere through the first three-position electromagnetic proportional flow valve and air inside the right air spring is discharged into atmosphere through the second three-position electromagnetic proportional flow valve; and the differential pressure valve is configured to communicate with the left auxiliary air chamber and the right auxiliary air chamber; and the two-position switching valve communicates with the left auxiliary air chamber and the right auxiliary air chamber through pipelines, respectively.

2. The tilting system of claim 1, further comprising a third three-position solenoid valve and a fourth three-position solenoid valve; wherein the third three-position solenoid valve communicates with the high-pressure air cylinder, the left air spring and the atmosphere, respectively; the fourth three-position solenoid valve communicates with the high-pressure air cylinder and the right air spring and the atmosphere, respectively; and the third three-position solenoid valve and the fourth three-position solenoid valve are controlled by the controller to open and close.

3. The tilting system of claim 2, wherein the third three-position solenoid valve is a three-position electromagnetic switching valve or a three-position electromagnetic proportional flow valve; and/or the fourth three-position solenoid valve is a three-position electromagnetic switching valve or a three-position electromagnetic proportional flow valve.

4. A railway vehicle, comprising:

the tilting system for railway vehicle of claim 3.

5. A railway vehicle, comprising:

the tilting system for railway vehicle of claim 3.

6. A tilting control method of the tilting system of railway vehicle of claim 1, comprising:

step S11, receiving, by the controller, a real-time unbalanced centrifugal acceleration of a frame collected by an acceleration sensor, and comparing the real-time unbalanced centrifugal acceleration of the frame with a preset unbalanced centrifugal acceleration threshold; and step S12, generating, when the real-time unbalanced centrifugal acceleration of the frame is greater than the preset unbalanced centrifugal acceleration threshold, control instructions for the first three-position electromagnetic proportional flow valve and the second three-position electromagnetic proportional flow valve based on the real-time unbalanced centrifugal acceleration of the frame, a real-time height value of the left air spring and a real-time height value of the right air spring to perform an operation of charging air or discharging air on the left air spring and the right air spring.

7. The tilting control method of claim 6, wherein the generating control instructions for the first three-position electromagnetic proportional flow valve and the second three-position electromagnetic proportional flow valve based on the real-time unbalanced centrifugal acceleration of the frame, a real-time height value of the left air spring and a real-time height value of the right air spring comprises:

calculating a tilting angle of a body of the railway vehicle based on the real-time unbalanced centrifugal acceleration of the frame;

calculating a target value of a height difference between the left air spring and the right air spring based on the tilting angle of the body of the railway vehicle;

calculating a height change target value of the left air spring, a height change target value of the right air spring, and a height change speed value of the left air spring and a height change speed value of the right air spring based on the target value of a height difference between the left air spring and the right air spring; and generating control instructions for the first three-position electromagnetic proportional flow valve and the second three-position electromagnetic proportional flow valve based on the received real-time height value of the left air spring and the real-time height value of the right air spring in combination with the height change target value of the left air spring, the height change target value of the right air spring, the height change speed value of the left air spring and the height change speed value of the right air spring.

8. The tilting control method of claim 6, wherein the generating control instructions for the first three-position electromagnetic proportional flow valve and the second three-position electromagnetic proportional flow valve based on the real-time unbalanced centrifugal acceleration of the frame, a real-time height value of the left air spring and a real-time height value of the right air spring comprises:

calculating a change rate of the real-time unbalanced centrifugal acceleration of the frame based on the real-time unbalanced centrifugal acceleration of the frame; and obtaining a feedforward control amount of the left air spring and a feedforward control amount of the right air spring based on the change rate of the real-time unbalanced centrifugal acceleration of the frame;

calculating a height target value of the left air spring and a height target value of the right air spring based on the real-time unbalanced centrifugal acceleration of the frame;

determining a feedback control amount of the left air spring based on the real-time height value of the left air spring and the height target value of the left air spring; and determining a feedback control amount of the right air spring based on the real-time height value of the right air spring and the height target value of the right air spring; and generating the control instruction for the first three-position electromagnetic proportional flow valve based on the feedback control amount of the left air spring and the feedforward control amount of the left air spring; and generating the control instruction for the second three-position electromagnetic proportional flow valve based on the feedback control amount of the right air spring and the feedforward control amount of the right air spring.

9. The tilting control method of claim 6, further comprising:

when the railway vehicle exits a curve road section, balancing the left air spring and the right air spring, wherein when the railway vehicle exits an easement curve road section, the real-time unbalanced centrifugal acceleration of the frame gradually decreases, and an outer air spring begins to discharge air and a height of the outer air spring is lowered; when a height deviation value of the left air spring is equal to a height deviation value of the right air spring, the two-position control switching valve is opened to allow air inside an outer air spring to flow into an inner air spring such that the left air spring and the right air spring return to a balanced state; wherein the outer air spring is an air spring with a relatively higher height of the left air spring and the right air spring, and the inner air spring is an air spring with a relatively lower height of the left air spring and the right air spring, the height deviation value of the left air spring is a difference between the real-time height value of the left air spring and a target height value of the left air spring and the height deviation value of the right air spring is a difference between the real-time height value of the right air spring and a target height value of the right air spring.

10. The tilting control method of claim 6, further comprising:

step S21, when the real-time unbalanced centrifugal acceleration of the frame is less than or equal to the preset unbalanced centrifugal acceleration threshold, receiving, by the controller, the real-time height value of the left air spring and the real-time height value of the right air spring, and calculating a first height deviation value based on the real-time height value of the left air spring and a second height deviation value based on the real-time height value of the right air spring; and step S22, comparing the first height deviation value with a preset first interval, and when the first height deviation value is outside the first interval, adjusting the height of the left air spring by controlling the first three-position electromagnetic proportional flow valve; and comparing the second height deviation value with a preset second interval, and when the second height deviation value is outside the second interval, adjusting the height of the right air spring by controlling the second three-position electromagnetic proportional flow valve.

11. A railway vehicle, comprising:

the tilting system for railway vehicle of claim 1.

* * * * *